US007441884B2

(12) United States Patent
Kawauchi et al.

(10) Patent No.: US 7,441,884 B2
(45) Date of Patent: Oct. 28, 2008

(54) RECORDING APPARATUS

(75) Inventors: Kenichi Kawauchi, Ebina (JP); Akira Mihara, Ebina (JP); Satoshi Mohri, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 352 days.

(21) Appl. No.: 11/062,362

(22) Filed: Feb. 22, 2005

(65) Prior Publication Data

US 2006/0028524 A1 Feb. 9, 2006

(30) Foreign Application Priority Data

Aug. 4, 2004 (JP) ..... 2004-227569

(51) Int. Cl.
*B41J 2/01* (2006.01)

(52) U.S. Cl. ..... 347/104; 347/37

(58) Field of Classification Search ..... 347/37, 347/104

See application file for complete search history.

(56) References Cited

U.S. PATENT DOCUMENTS 4,272,181 A * 6/1981 Treseder ..... 399/401
4,319,833 A * 3/1982 Hidding ..... 355/23
5,836,706 A * 11/1998 Ruhe ..... 400/636
6,296,405 B1 * 10/2001 Brewington et al. ..... 400/188
6,354,700 B1 * 3/2002 Roth ..... 347/103
6,760,093 B2 * 7/2004 Kawabata et al. ..... 355/27
7,097,297 B2 * 8/2006 Hasebe et al. ..... 347/102
2005/0212197 A1 * 9/2005 Teo et al. ..... 271/186
2006/0044345 A1 * 3/2006 Jones et al. ..... 347/37

FOREIGN PATENT DOCUMENTS

JP 2002-1938 1/2002

* cited by examiner

*Primary Examiner*—Manish S. Shah
*Assistant Examiner*—Mark J Stevenosky, Jr.
(74) *Attorney, Agent, or Firm*—Fildes & Outland, P.C.

(57) ABSTRACT

A recording apparatus includes a transport unit that conveys a recording medium and a recording head unit that records an image on the recording medium conveyed by the transport unit. The transport unit includes a straight transport unit that straightly conveys the recording medium. The transport unit also includes a looped transport unit that branches and turns from the straight transport unit and returns the recording medium to the straight transport unit. A first recording region is disposed at the looped transport unit and a second recording region is disposed at the straight transport unit.

9 Claims, 12 Drawing Sheets

(FIG. 4 CONTINUED)
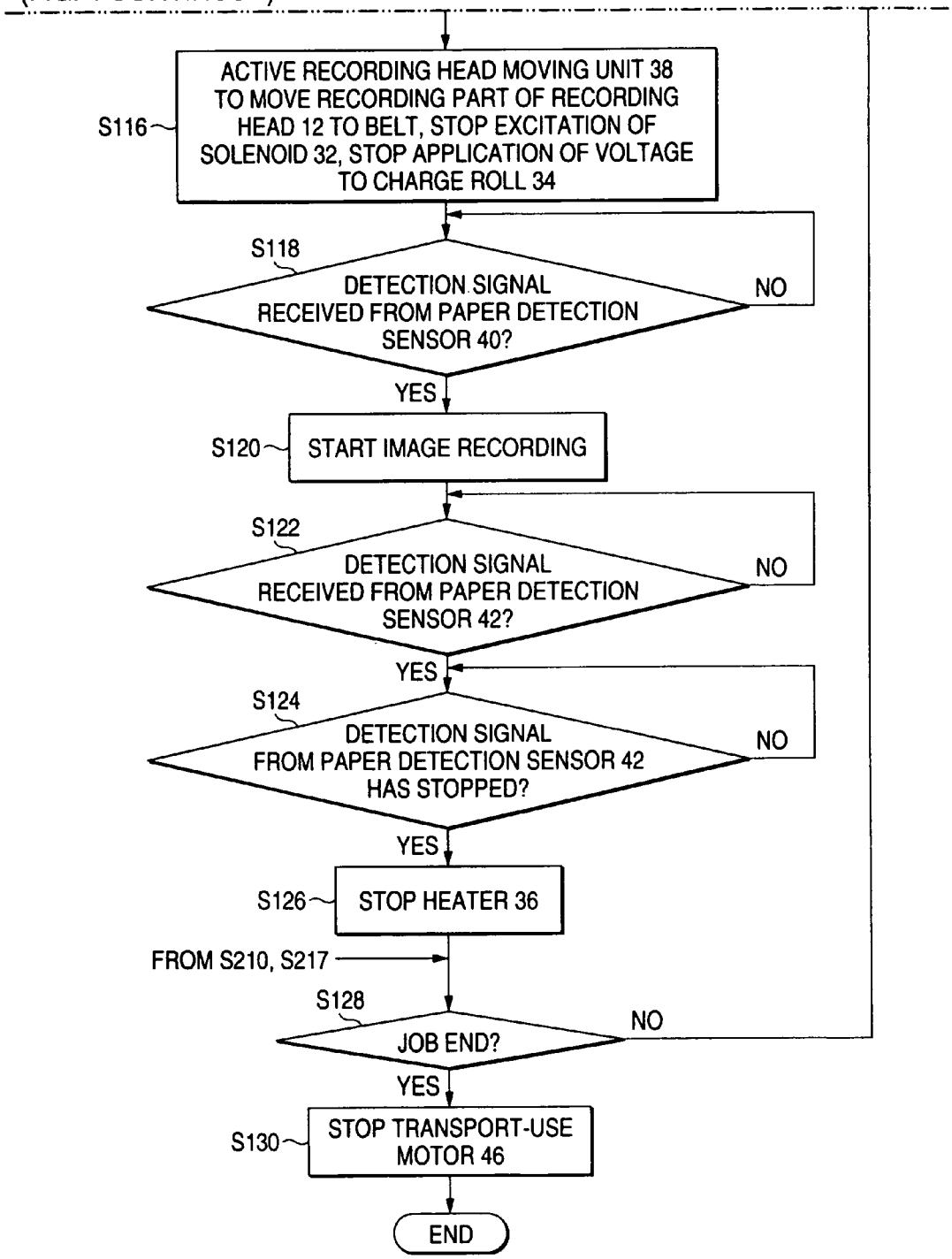

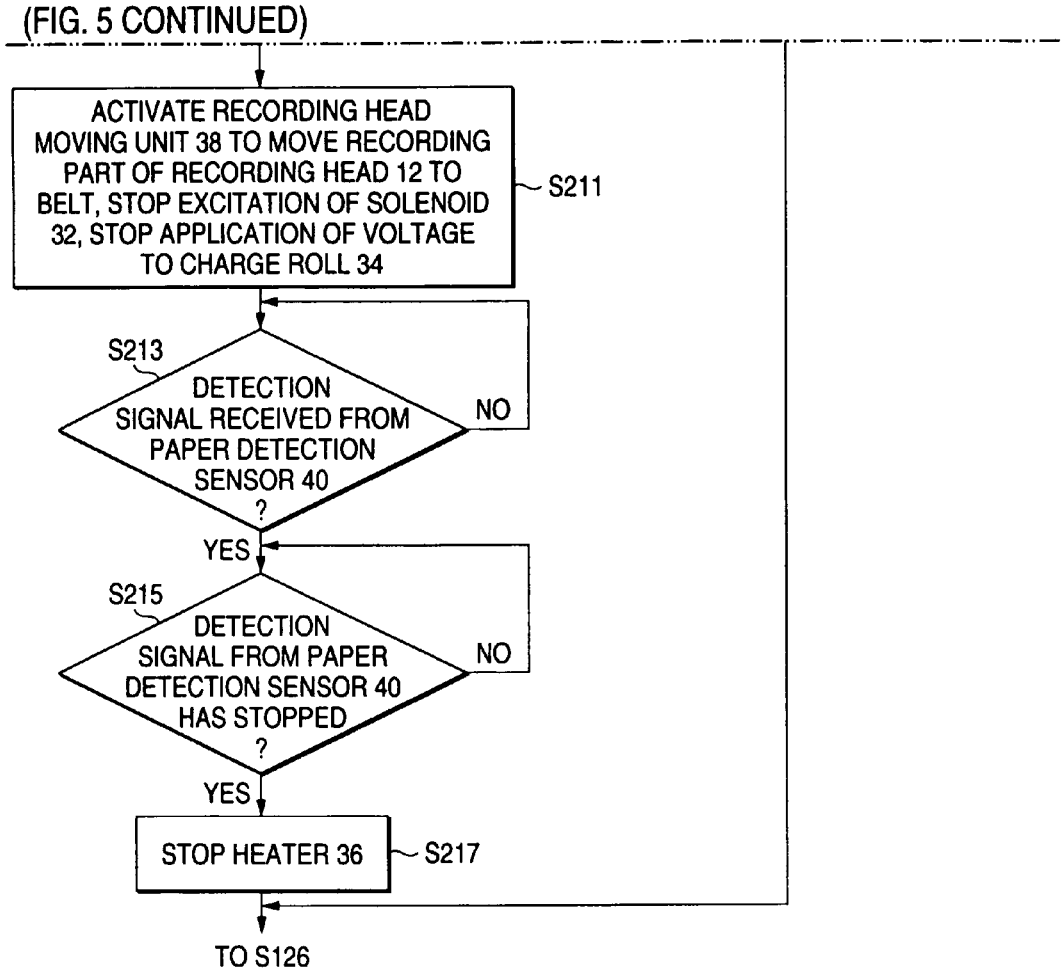
(FIG. 5 CONTINUED)
ACTIVATE RECORDING HEAD MOVING UNIT 38 TO MOVE RECORDING PART OF RECORDING HEAD 12 TO BELT, STOP EXCITATION OF SOLENOID 32, STOP APPLICATION OF VOLTAGE TO CHARGE ROLL 34
S211
S213
DETECTION SIGNAL RECEIVED FROM PAPER DETECTION SENSOR 40 ?
NO
YES
S215
DETECTION SIGNAL FROM PAPER DETECTION SENSOR 40 HAS STOPPED ?
NO
YES
STOP HEATER 36
S217
TO S126

RECORDING APPARATUS

BACKGROUND OF THE INVENTION

1. Field of the Invention

The present invention relates to a recording apparatus that records an image with a recording head on both sides of a recording medium conveyed by a transport unit.

2. Description of the Related Art

Conventionally, in a recording apparatus such as an inkjet printer that records an image on both sides of a recording medium, an image is recorded on the front side of the recording medium, and the recording medium is discharged once to the outside of the apparatus. Then, the recording medium is again sent to the recording head through a dedicated path for inverting the front side and the back side of the recording medium, and an image is recorded on the back side of the recording medium. In such a recording apparatus, there has been the problem that the amount of time from when image recording on the front side of the recording medium ends to until image recording on the back side of the recording medium begins becomes long, and the printing speed of double-sided printing becomes slow.

As a configuration that addresses this problem, a configuration has been proposed where two drums are disposed in an image recording unit, the recording medium is snaked between the two drums, the front side of the recording medium is made to face outward at the drum at the upstream side of the transport direction, the recording medium is adhered to the drum, and image recording is conducted on the front side of the recording medium. Then, the back side of the recording medium is made to face outward at the drum at the downstream side of the transport direction, the recording medium is adhered to the drum, and image recording is conducted on the back side of the recording medium (e.g., see JP-A- 2002- 1938).

However, with this configuration, there has been the problem that the recording apparatus becomes large as a result of disposing the two drums. There has also been the problem that the drum diameters become large in order to adhere recording media that are difficult to curve, such as thick paper, and the recording apparatus becomes even larger. Moreover, there has also been the problem that the amount of transport time when an image is recorded on only one side of the recording medium becomes long as a result of continually snaking the recording medium, and the printing speed of a single-sided print becomes slow.

SUMMARY OF THE INVENTION

The present invention has been made in view of the above circumstances and provides a recording apparatus that records an image on both sides of a recording medium, where the recording apparatus is made compact and the amount of transport time when recording an image on only one side is shortened.

According to an aspect of the invention, the recording apparatus includes a transport unit that conveys a recording medium and a recording head unit that records an image on the recording medium conveyed by the transport unit. The transport unit includes a straight transport unit that straightly conveys the recording medium. The transport unit also includes a looped transport unit that branches and turns from the straight transport unit and returns the recording medium to the straight transport unit. A first recording region is disposed at the looped transport unit and a second recording region is disposed at the straight transport unit.

BRIEF DESCRIPTION OF THE DRAWINGS

Embodiments of the invention will be described in detail on the basis of the following figures, wherein.

DETAILED DESCRIPTION OF THE INVENTION

A first embodiment of the invention will be described below with reference to the drawings.

Figure 1:
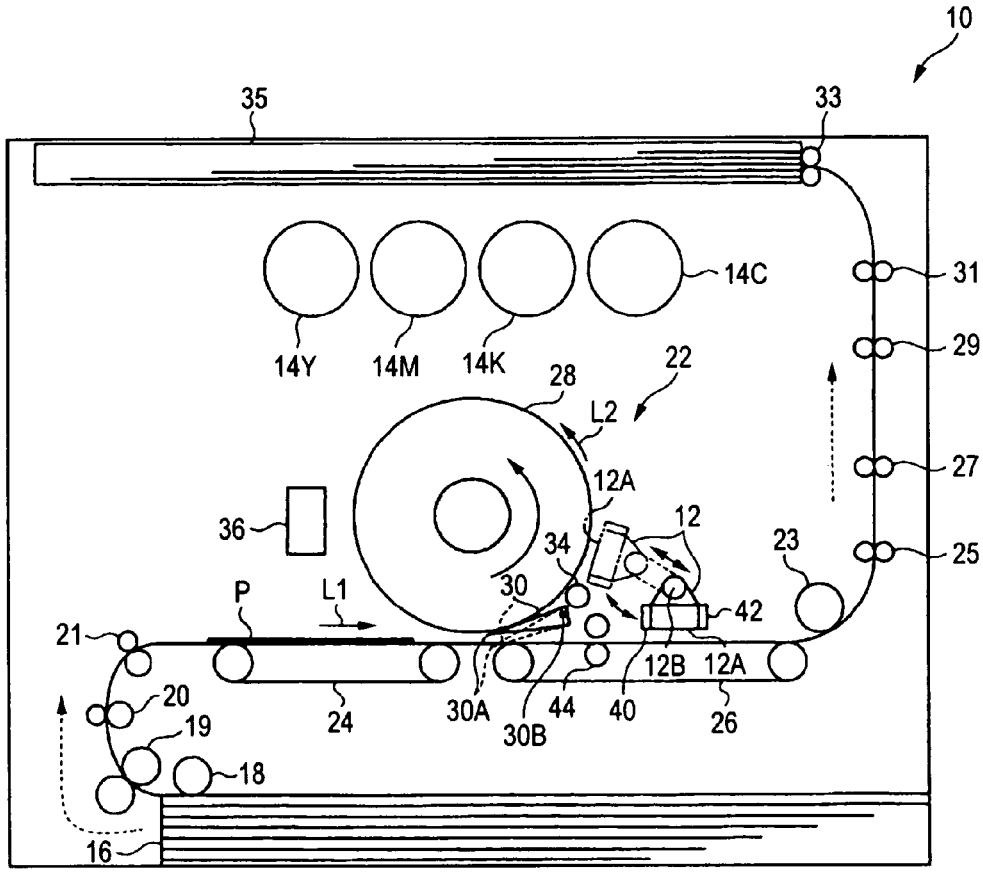
FIG. 1 is a schematic diagram showing a recording apparatus of a first embodiment of the invention.
Figure 2:
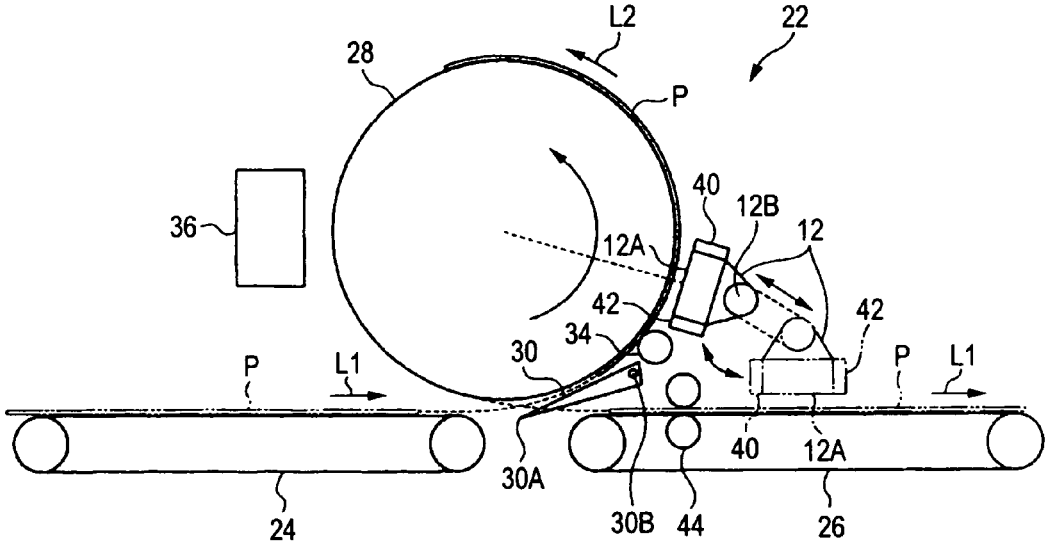
FIG. 2 is a schematic diagram showing an image recording unit of the recording apparatus of the first embodiment of the invention.

As shown in FIGS. 1 and 2, a recording apparatus 10 is a full-color inkjet printer that forms a full-color image on paper P with inks of the four colors of yellow (Y), magenta (M), black (K) and cyan (C).

A paper supply tray 16 is removably disposed in the lowermost portion of the recording apparatus 10. Sheets of paper P are stacked in the paper supply tray 16, and a pickup roll 18 contacts the uppermost sheet of paper P. The paper P is supplied upward one by one from the paper supply tray 16 by the pickup roll 18, and supplied to an image recording unit 22 by transport rolls 19, 20 and 21 successively disposed along a transport path. A recording head 12, in which inkjet recording heads of the four colors of YMKC are integrated, is disposed in the image recording unit 22. The inkjet recording heads of the recording head 12 are connected by pipes to ink tanks 14Y, 14M, 14K and 14C disposed above the image recording unit 22. The inks supplied from the ink tanks 14Y, 14M, 14K and 14C are jetted towards the paper P from nozzles. With respect to the method of jetting the ink droplets, a known method may be applied, such as a thermal method or a method where the ink tanks are pressurized with piezoelectric elements, but in the present embodiment, a method is used where the ink tanks are pressurized with piezoelectric elements. The image recording unit 22 will be described in detail later.

Transport rolls 23, 25, 27, 29, 31 and 33 are successively disposed in the transport direction at the transport-direction downstream side of the image recording unit 22. These transport rolls convey the paper P upward after an image has been recorded on the paper P by the image recording unit 22. A paper discharge tray 35 is disposed above the image recording unit 22, and the transport rolls 33 are disposed at a side of the paper discharge tray 35. Namely, the paper P is discharged onto the paper discharge tray 35 by the transport rolls 33.

Transport belts 24 and 26, which attract and retain the paper P with a known method such as electrostatic attraction or suction and move the paper P straight in the horizontal direction, are disposed in the image recording unit 22. A straight transport path L1 is formed by the transport belts 24 and 26, and a small gap is disposed between the transport belts 24 and 26.

An attraction-retention drum 28 is rotatably disposed in the image recording unit 22 above the conveyor belts 24 and 26 and facing the gap between the transport belts 24 and 26. The attraction-retention drum 28 attracts and retains the paper P with electrostatic attraction power, and rotates in the counter-clockwise direction in FIG. 1.

Here, as shown in FIGS. 1 and 2, a separation pawl 30 is disposed between the transport belt 26 and the attraction-retention drum 28. The separation pawl 30 is a pawl member that has a long and narrow triangular shape when seen in side view, and includes a sharp-pointed end portion 30A that protrudes between the transport belts 24 and 26. The separation pawl 30 is pivotably supported at the opposite side by a support shaft 30B. The separation pawl 30 is urged towards the attraction-retention drum 28 by an urging unit (not shown) to cause the end portion 30A to contact the lowermost portion of the attraction-retention drum 28.

Figure 3:
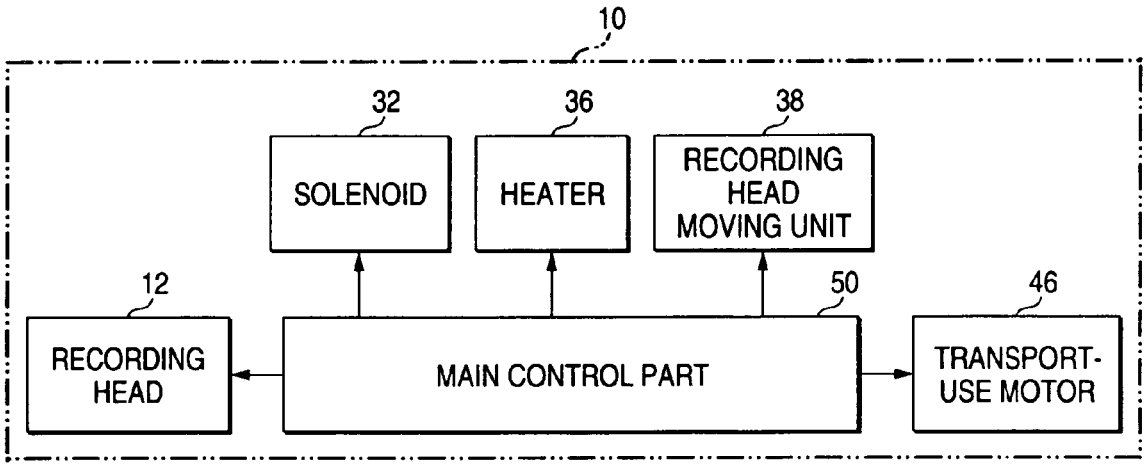
FIG. 3 is a schematic block diagram showing the recording apparatus of the first embodiment of the invention.

A solenoid 32 (omitted from FIGS. 1 and 2; see FIG. 3), which causes the separation pawl 30 to swing towards the transport belt 26 counter to the urging force of the urging unit, is also disposed. When the solenoid 32 is excited, the end portion 30A of the separation pawl 30 is lowered below the upper surfaces of the transport belts 24 and 26.

Thus, in a state where the solenoid 32 is excited, the paper P conveyed horizontally by the transport belt 24 to the separation pawl 30 is scooped up by the end portion 30A of the separation pawl 30 and enters a gap between the separation pawl 30 and the attraction-retention drum 28.

At the rotation-direction downstream side of the attraction-retention drum 28 from the separation pawl 30 (called "the rotation-direction downstream side" below), a charge roll 34 contacts the attraction-retention drum 28, and the paper P passing through the gap between the separation pawl 30 and the attraction-retention drum 28 is charged by the charge roll 34 and electrostatically attracted to the attraction-retention drum 28. Then, the attraction-retention drum 28 attracts and retains the paper P and rotates in the counter-clockwise direction in FIG. 1, whereby a looped transport path L2 is formed.

The recording head 12 is disposed at the rotation-direction downstream side from the charge roll 34. The recording head 12 includes a nozzle surface 12A that is disposed with nozzles and faces the peripheral surface of the attraction-retention drum 28. The recording head 12 jets ink droplets towards the surface of the paper P that is attracted to and retained on the attraction-retention drum 28 and conveyed along the looped transport path L2. The orientation of the nozzle surface 12A of the recording head 12, i.e., a recording part that records an image, can be moved, but the details thereof will be described later.

A heater 36 is disposed at the rotation-direction downstream side from the recording head 12. The heater 36 dries the surface of the paper P on which the ink image has been formed. Then, the paper P passes through the drying unit configured by the heater 36 and is conveyed to the separation pawl 30.

Figure 7:
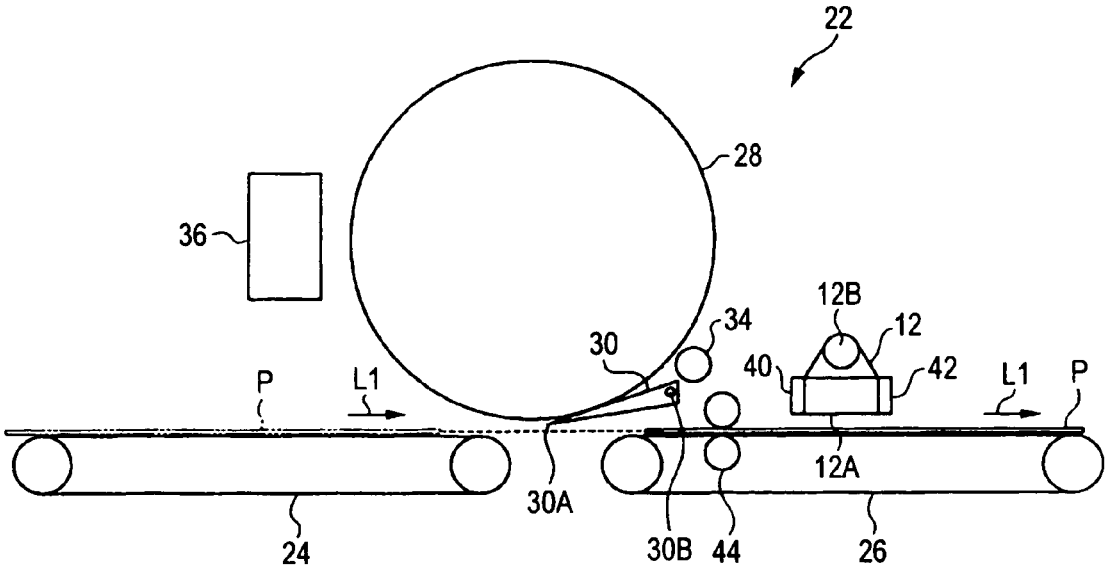
FIG. 7 is a schematic diagram showing the image recording unit of the recording apparatus of the first embodiment of the invention.

At this time, when the solenoid 32 is not excited, the end portion 30A of the separation pawl 30 contacts the attraction-retention drum 28 with the urging force of the urging unit, enters a gap between the paper P and the peripheral surface of the attraction-retention drum 28, and separates the paper P from the attraction-retention drum 28. Then, when the paper P is separated from the attraction-retention drum 28, the paper P is sent to the transport belt 26 by the rotational force of the attraction-retention drum 28. It will be noted that, as shown in FIG. 7, when the paper P is conveyed to the separation pawl 30 by the transport belt 24 in a state where the solenoid 32 is not excited, the paper P advances directly to the transport belt 26 along the undersurface of the separation pawl 30.

Here, the mechanism for moving the recording part of the recording head 12 will be described. A support shaft 12B that extends in the direction orthogonal to the transport direction of the paper P is disposed in the recording head 12. The recording head 12 is rotatable around the support shaft 12B, and is configured to move towards and away from the attraction-retention drum 28. Also, a recording head moving unit 38 (see FIG. 3) is disposed which causes the recording head 12 to rotate and move towards and away from the attraction-retention drum 28 and the transport belt 26, thereby causing the nozzle surface 12A of the recording head 12 to move from the attraction-retention drum 28 to the transport belt 26 or to move from the transport belt 26 to the attraction-retention drum 28.

The recording head moving unit 38 first moves away the recording head 12 from the attraction-retention drum 28 from the state where the recording part of the recording head 12 is positioned at the peripheral surface of the attraction-retention drum 28, as shown by the solid lines in FIG. 2. Next, when the recording head 12 is moved to a position where the nozzle surface 12A does not interfere with the peripheral surface of the attraction-retention drum 28 and the transport belt 26 by the rotation of the recording head 12, the recording head moving unit 38 rotates the recording head 12 in the counter-clockwise direction in FIG. 2. Then, when the nozzle surface 12A faces the upper surface of the transport belt 26 and the distance between the nozzle surface 12A and the upper surface of the transport belt 26 becomes a predetermined distance suitable for conducting printing, the recording head moving unit 38 stops the rotation and direct movement of the recording head 12, as shown by the two-dot chain lines in FIG. 2. Thus, the recording part of the recording head 12 is moved from the peripheral surface of the attraction-retention drum 28 to the upper surface of the transport belt 26.

Also, when the recording head moving unit 38 moves the recording part of the recording head 12 from the upper surface of the transport belt 26 to the peripheral surface of the attraction-retention drum 28, first, the recording head moving unit 38 moves away the recording head 12 from the transport belt 26 and rotates the recording head 12 in the clockwise direction in FIG. 2 until the recording head 12 is moved to a position where the nozzle surface 12A does not interfere with the peripheral surface of the attraction-retention drum 28 and the transport belt 26 by the rotation of the recording head 12. Then, when the nozzle surface 12A faces the peripheral surface of the attraction-retention drum 28 and the distance between the nozzle surface 12A and the peripheral surface of the attraction-retention drum 28 becomes a predetermined distance suitable for conducting printing, the recording head moving unit 38 stops the rotation and direct movement of the recording head 12.

Here, two paper detection sensors 40 and 42 are attached to the recording head 12. The paper detection sensor 40 is positioned at the transport-direction upstream side from the nozzle surface 12A in the straight transport path L1 and at the transport-direction downstream side from the nozzle surface 12A in the looped transport path L2. The paper detection sensor 42 is positioned at the transport-direction downstream side from the nozzle surface 12A in the straight transport path L1 and at the transport-direction upstream side from the nozzle surface 12A in the looped transport path L2.

Namely, in the straight transport path L1, the paper detection sensor 40 detects that the leading end of the paper P has been conveyed to the front of the recording part of the recording head 12, and the paper detection sensor 42 detects that the trailing end of the paper P has passed the recording part of the recording head 12. In the looped transport path L2, the paper detection sensor 42 detects that the leading end of the paper P has been conveyed to the front of the recording part of the recording head 12, and the detection sensor 40 detects that the trailing end of the paper P has passed the recording part of the recording head 12.

A main control part 50 (see FIG. 3) that controls the entire recording apparatus 10 initiates the jetting of the ink droplets of the recording head 12 after a predetermined period of time elapses when the main control part 50 receives a detection signal from the paper detection sensor 40 when the paper P is being conveyed along the straight transport path L1, and drives the recording head moving unit 38 in response to the status of the print job to move the recording part of the recording head 12 to the looped transport path L2, when the detection signal from the paper detection sensor 42 ends. The main control part 50 also initiates the jetting of the ink droplets of the recording head 12 after a predetermined period of time elapses when the main control part 50 receives a detection signal from the paper detection sensor 42 when the paper P is being conveyed along the looped transport path L2, and drives the recording head moving unit 38 in response to the status of the print job, to move the recording part of the recording head 12 to the straight transport path L1, when the detection signal from the paper detection sensor 40 ends.

Rolls 44 that sandwich the transport belt 26 are disposed between the separation pawl 30 and the recording part of the recording head 12 in the straight transport path L1. The rolls 44 nip the paper P on the transport belt 26 and flatly smooth the paper P. Thus, the behavior of the separated paper P is stabilized, and the image quality of the image recording conducted in the straight transport path L1 is stabilized.

Figure 4:
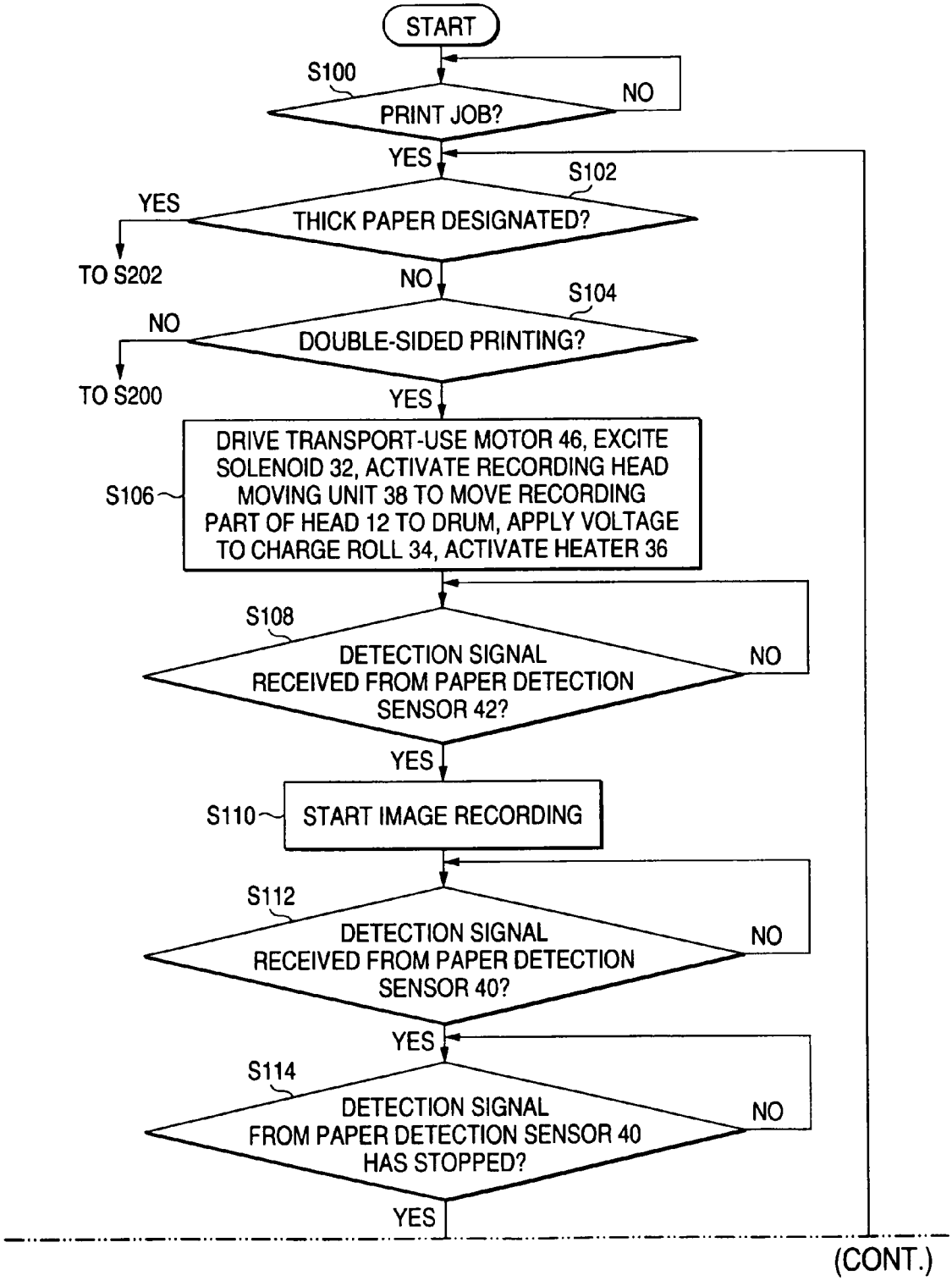
FIG. 4 is a flow chart for describing a printing operation of the recording apparatus of the first embodiment of the invention.
Figure 5:
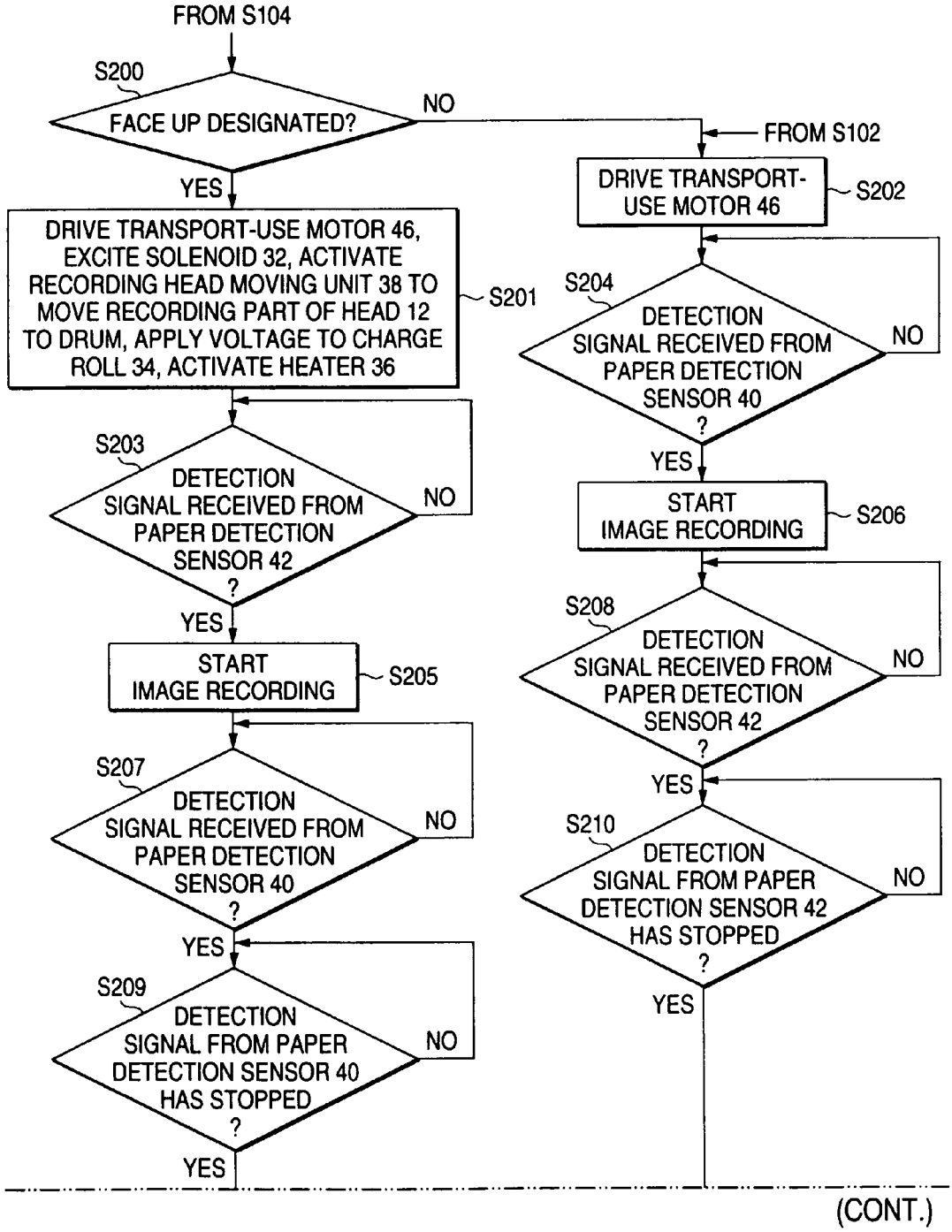
FIG. 5 is a flow chart for describing the printing operation of the recording apparatus of the first embodiment of the invention.

Here, the printing operation of the recording apparatus 10 will be described with reference to the flow charts of FIGS. 4 and 5.

First, when the recording apparatus 10 is turned ON, the present flow begins and the operation proceeds to step 100. In step 100, a negative determination is repeated until the main control part 50 receives a print job, and when the determination is affirmative, the operation proceeds to step 102. In step 102, it is determined whether or not the print job is one where thick paper has been designated. When the determination is affirmative, the operation proceeds to step 202 of FIG. 5, and when the determination is negative, the operation proceeds to step 104.

Figure 6A:
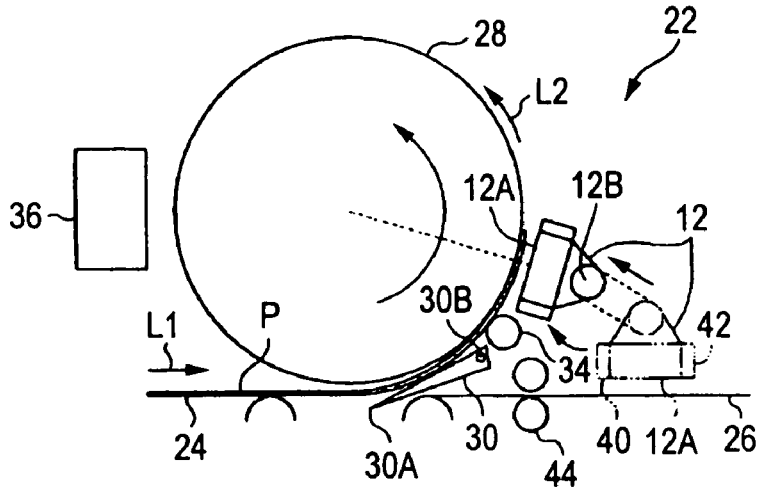
FIGS. 6A to 6C are schematic diagrams showing the image recording unit of the recording apparatus of the first embodiment of the invention.

In step 104, it is determined whether or not the job is one where double-sided printing has been designated. When the determination is negative, the operation proceeds to step 200 of FIG. 5, and when the determination is affirmative, the operation proceeds to step 106. In step 106, a transport-use motor 46 that drives the transport unit such as the most-upstream pickup roll 18, the transport rolls 19, the transport belts 24 and 26 and the attraction-retention drum 28 is driven, and the paper P is supplied to the image recording unit 22. The transmission of the drive to the pickup roll 18 is cut off once each time one sheet of the paper P is sent out. Also, as shown in FIG. 6A, the solenoid 32 is excited, the end portion 30A of the separation pawl 30 is lowered, the recording head moving unit 38 is activated, and the recording part of the recording head 12 is moved to the looped transport path L2. Also, voltage is applied to the charge roll 34 and the heater 36 is activated. It will be noted that the recording part of the recording head 12 is positioned on the straight transport path L1 in an initial state. The paper P conveyed to the image recording unit 22 is conveyed by the transport belt 24 to the separation pawl 30, scooped up by the end portion 30A of the separation pawl 30 and guided to the looped transport path L2. Then, the paper P is charged by the charge roll 34 and electrostatically attracted to the attraction-retention drum 28. Then, the operation proceeds to step 108.

In step 108, a negative determination is repeated until the detection signal is received from the paper detection sensor 42. When the determination is affirmative, the operation proceeds to step 110. In step 110, the recording head 12 begins image recording when the leading end of the paper P reaches the recording part of the recording head 12 after a predetermined amount of time elapses after the detection signal is received from the paper detection sensor 42. Then, the operation proceeds to step 112.

Figure 6B:
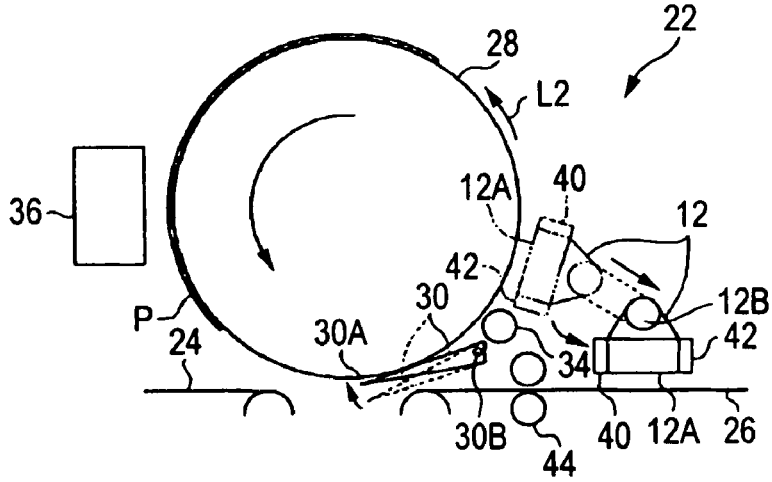
Figure 6C:
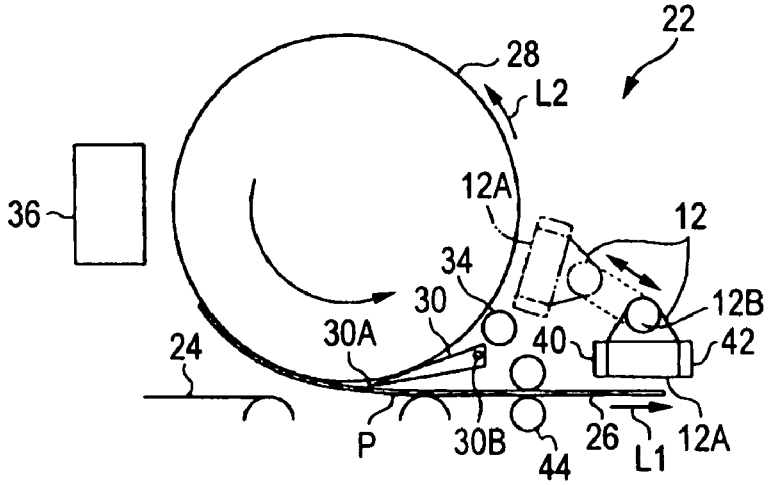

In step 112, a negative determination is repeated until the detection signal is received from the paper detection sensor 40. When the determination is affirmative, the operation proceeds to step 114. In step 114, a negative determination is repeated until the detection signal from the paper detection sensor 40 ends. When the determination is affirmative, the operation proceeds to step 116. In step 116, as shown in FIG. 6B, the recording head moving unit 38 is driven, the recording part of the recording head 12 is moved from the looped transport path L2 to the straight transport path L1, the excitation of the solenoid 32 is stopped, and the application of voltage to the charge roll 34 is stopped. The front side of the paper P on which an ink image has been formed is dried when the paper P passes through the heating region of the heater 36. For this reason, the ink image is not disturbed even if the image recording surface of the paper P contacts the transport belt 26 thereafter. Then, as shown in FIG. 6C, when the paper P has passed through the heating region of the heater 36, the paper P is separated from the attraction-retention drum 28 by the end portion 30A of the separation pawl 30 contacting the attraction-retention drum 28 and guided to the transport belt 26. Then, the paper P is flatly smoothed by the rolls 44 when the paper P is conveyed by the transport belt 26 to the recording part of the recording head 12. Then, the operation proceeds to step 118.

In step 118, a negative determination is repeated until the detection signal is received from the paper detection sensor 40. When the determination is affirmative, the operation proceeds to step 120. In step 120, the recording head 12 begins image recording when the leading end of the paper P reaches the recording part of the recording head 12 after a predetermined amount of time elapses after the detection signal is received from the paper detection sensor 40. Then, the operation proceeds to step 122.

In step 122, a negative determination is repeated until the detection signal is received from the paper detection sensor 42. When the determination is affirmative, the operation proceeds to step 124. In step 124, a negative determination is repeated until the detection signal from the paper detection sensor 42 stops, and when the determination is affirmative, the operation proceeds to step 126. At this time, the heater 36 is stopped in step 126 because the paper P has passed through the heating region of the heater 36. Then, the operation proceeds to step 128.

In step 128, a negative determination is repeated until the print job ends, and the operation returns to step 102. When the determination is affirmative, the operation proceeds to step 130. In step 130, the transport-use motor 46 is stopped. Then, the present flow ends.

Next, the case of a job where thick paper has been designated and the case of a job of one-sided printing will described with reference to the flow chart of FIG. 5. In step 200, it is determined whether or not the print job is one where face-up has been designated as the mode of discharging the paper P. When the determination is negative, the operation proceeds to step 202, and when the determination is affirmative, the operation proceeds to step 201.

In step 201, the transport-use motor 46 is driven, the paper P is supplied to the image recording unit 22, the solenoid 32 is excited, and the end portion 30A of the separation pawl 30 is lowered. Also, the recording head moving unit 38 is activated, the recording part of the recording head 12 is moved to the looped transport path L2, voltage is applied to the charge roll 34, and the heater 36 is activated. The paper P conveyed to the image recording unit 22 is conveyed by the transport belt 24 to the separation pawl 30, scooped up by the end portion 30A of the separation pawl 30 and guided to the looped transport path L2. Then, the paper P is charged by the charge roll 34 and electrostatically attracted to the attraction-retention drum 28. Then, the operation proceeds to step 203.

In step 203, a negative determination is repeated until the detection signal is received from the paper detection sensor 42. When the determination is affirmative, the operation proceeds to step 205. In step 205, the recording head 12 begins image recording when the leading end of the paper P reaches the recording part of the recording head 12 after a predetermined amount of time elapses after the detection signal is received from the paper detection sensor 42. Then, the operation proceeds to step 207.

In step 207, a negative determination is repeated until the detection signal is received from the paper detection sensor 40. When the determination is affirmative, the operation proceeds to step 209. In step 209, a negative determination is repeated until the detection signal from the paper detection sensor 40 stops, and when the determination is affirmative, the operation proceeds to step 211.

In step 211, as shown in FIG. 6B, the recording head moving unit 38 is driven, the recording part of the recording head 12 is moved from the looped transport path L2 to the straight transport path L1, the excitation of the solenoid 32 is stopped, and the application of voltage to the charge roll 34 is stopped. The front side of the paper P on which an ink image has been formed is dried when the paper P passes through the heating region of the heater 36.

In step 213, a negative determination is repeated until the detection signal is received from the paper detection sensor 40. When the determination is affirmative, the operation proceeds to step 215. In step 215, a negative determination is repeated until the detection signal from the paper detection sensor 40 stops, and when the determination is affirmative, the operation proceeds to step 217. At this time, the heater 36 is stopped in step 217 because the paper P has passed through the heating region of the heater 36.

As shown in FIG. 6C, when the paper P has passed through the heating region of the heater 36, the paper P is separated from the attraction-retention drum 28 by the end portion 30A of the separation pawl 30 contacting the attraction-retention drum 28, guided to the transport belt 26, and conveyed by the transport belt 26 with the image recording surface face down. Then, the paper P is conveyed upward by the transport rolls 23, 25, 27, 29, 31 and 33, and discharged to the discharge tray 35 with the image recording surface face up. Then, the operation proceeds to step 126 of FIG. 5.

In the case of a print job where thick paper has been designated or there is no face-up designation, the transport-use motor 46 is driven and the paper P is supplied to the image recording unit 22 in step 202. Then, in step 204, a negative determination is repeated until the detection signal is received from the paper detection sensor 40, and when the determination is affirmative, the operation proceeds to step 206. In step 206, the recording head 12 begins image recording when the leading end of the paper P reaches the recording part of the recording head 12 after a predetermined amount of time elapses after the detection signal is received from the paper detection sensor 40. Then, the operation proceeds to step 208. In step 208, a negative determination is repeated until the detection signal is received from the paper detection sensor 42. When the determination is affirmative, the operation proceeds to step 210. In step 210, a negative determination is repeated until the detection signal from the paper detection sensor 42 stops, and when the determination is affirmative, the operation proceeds to step 126 of FIG. 5. As described above, when the print job ends, the transport-use motor 46 is stopped and the present flow ends.

As shown in FIG. 7, with a one-sided print job where face-up has not been designated and a job where thick paper has been designated, the paper P is conveyed straightly in the image recording unit 22. Thus, in comparison to conventional technology where the paper is snaked and conveyed through the image recording unit, the amount of transport time can be shortened and the printing speed can be increased.

Also, the unit for conveying the paper P in the image recording unit 22 is configured by one drum and one set of belts. Thus, in comparison to conventional technology where two drums are disposed in the image recording unit 22, the space occupied by the transport unit conveying the paper P in the image recording unit 22 can be reduced, and the recording apparatus 10 can be made compact.

Also, a dedicated transport path for inverting the paper P discharged in order to orient the paper P face up or face down becomes unnecessary. Thus, the recording apparatus 10 can be made compact, the cost can be reduced, and the amount of transport time can be shortened.

Also, the recording apparatus 10 is configured so that thick paper which is difficult to curve is straightly conveyed by the transport belts 24 and 26 without being attracted to and retained on the attraction-retention drum 28. Thus, the radius of the attraction-retention drum 28 can be set without consideration of the curvature of thick paper, whereby the attraction-retention drum 28 can be made compact and the recording apparatus 10 can be made compact.

Next, a second embodiment of the invention will be described. The same reference numerals will be given to portions that are the same as those of the first embodiment, and description of those same portions will be omitted.

Figure 8:
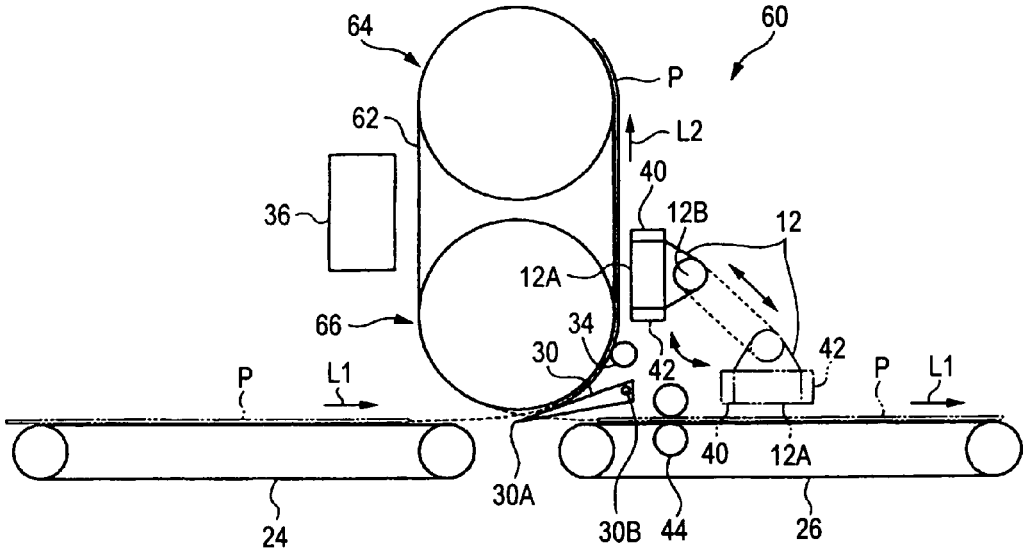
FIG. 8 is a schematic diagram showing an image recording unit of a recording apparatus of a second embodiment of the invention.

As shown in FIG. 8, an image recording unit 60 is disposed with an attraction-retention belt 62 instead of the attraction-retention drum 28 of the image recording unit 22 of the first embodiment. The attraction-retention belt 62 is wound around a drive roll 64 and a driven roll 66, which are vertically disposed. The attraction-retention belt 62 is rotated by the rotational force of the drive roll 64 rotated by a motor (not shown). Similar to the first embodiment, the charge roll 34 is disposed between the separation pawl 30 and the recording part of the recording head 12, the paper P is charged by the charge roll 34 and electrostatically attracted to the attraction-retention belt 62. Additionally, the looped transport path L2 is formed as a result of the attraction-retention belt 62 attracting/retaining the paper P and rotating.

Next, a third embodiment of the invention will be described. The same reference numerals will be given to portions that are the same as those of the first and second embodiments, and description of those same portions will be omitted.

Figure 9:
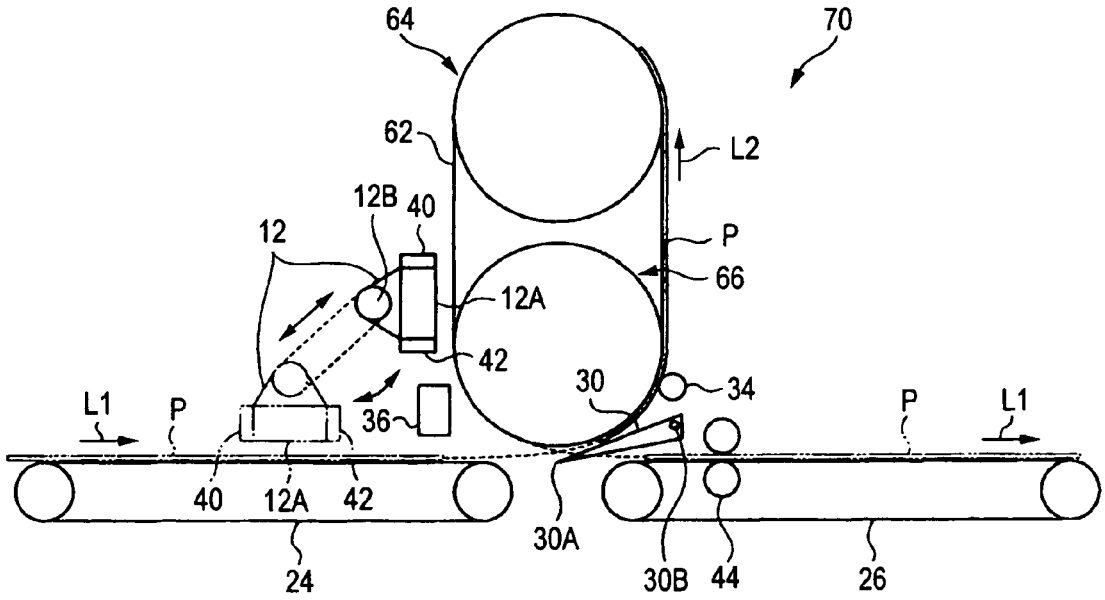
FIG. 9 is a schematic diagram showing an image recording unit of a recording apparatus of a third embodiment of the invention.

As shown in FIG. 9, a recording apparatus 70 includes the recording head 12 disposed above the transport belt 24. The nozzle surface 12A of the recording head 12 faces the upper surface of the transport belt 24 in the straight transport path L1 and faces the flat surface of the transport belt 24 side of the attraction-retention belt 62 in the looped transport path L2. Namely, first, an image is recorded on the front side of the paper P on the transport belt 24, and then an image is recorded on the back side of the paper P on the attraction-retention belt 62.

Figure 10:
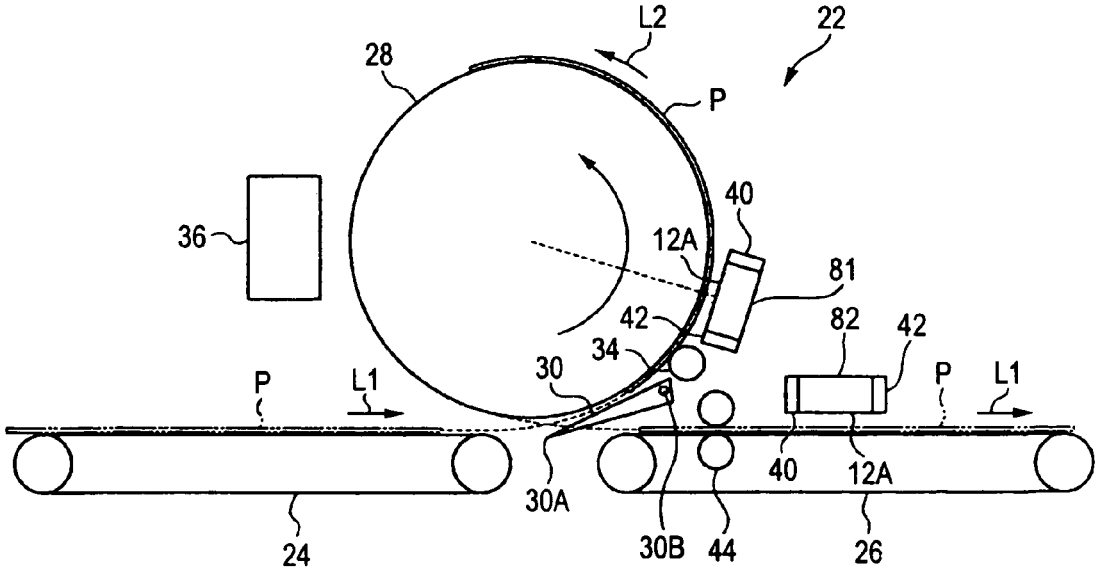
FIG. 10 is a schematic diagram showing a modified example of the image recording unit of the recording apparatus of the first to third embodiments of the invention.

It will be noted that in the first to third embodiments the present invention is described using, as an example, a configuration where a single inkjet recording head 12 is moved between the transport belt 24 or the transport belt 62 and the attraction-retention drum 28, but the present invention is not limited to this. As shown in FIG. 10, two recording heads 81 and 82 may also be disposed facing the attraction-retention drum 28 and the transport belt 24 (or the transport belt 26).

Also, in the first to third embodiments, a recording apparatus that forms an ink image on the paper P using an inkjet recording head is described, but the present invention is also applicable to image recording apparatus disposed with other recording heads, such as a recording apparatus that forms an image on heat-sensitive paper using a thermal head.

As described above, some embodiments of the invention are outlined below.

According to an embodiment of the invention, the recording apparatus includes a transport unit that conveys a recording medium and a recording head unit that records an image on the recording medium conveyed by the transport unit, wherein the transport unit includes a straight transport unit that straightly convey the recording medium, and a looped transport unit that branches and turns from the straight transport unit and returns the recording medium to the straight transport unit, a first recording region is disposed at the looped transport unit, and a second recording region is disposed at the straight transport unit.

In this recording apparatus, the recording medium is straightly conveyed by the straight transport unit, and then branches from the straight transport unit and is turned and returned to the straight transport unit by the looped transport unit. Then, the recording medium is again straightly conveyed by the straight transport unit.

Also, a first recording region is disposed at the looped transport unit and a second recording region is disposed at the straight transport unit. The recording head records an image on one side of the recording medium being conveyed by the looped transport unit, and records an image on the other side of the recording medium being conveyed by the straight transport unit.

Here, the transport unit that conveys the recording medium is configured by the straight transport unit and the looped transport unit, whereby the space occupied by the transport unit can be reduced and the recording apparatus can be made compact in comparison to conventional technology where two drums are disposed at the recording part of the recording head. Also, when an image is to be recorded only on one side of the recording medium, it suffices for the recording medium to be straightly conveyed by the straight transport unit. Thus, the amount of transport time when recording an image on only one side of the recording medium can be shortened and the printing speed during one-sided printing can be raised in comparison to conventional technology where the recording medium is continually snaked.

In the recording apparatus, the looped transport unit may be a rotating body that attracts and retains the recording medium and rotates, and the recording apparatus may further include an attraction separation unit that causes the recording medium conveyed by the straight transport unit to be attracted to and retained on the rotating body, separates the recording medium attracted to and retained on the rotating body from the rotating body, and guides the recording medium to the straight transport unit.

In this recording apparatus, the recording medium is conveyed straightly by the straight transport unit and attracted to the rotating body by the attraction separation unit. The recording medium turns towards the straight transport unit as a result of the rotating body attracting and retaining the recording medium and rotating. Then, the recording medium is separated from the rotating body by the attraction separation unit, guided to the straight transport unit and again straightly conveyed by the straight transport unit. An image is recorded on one side of the recording medium when the recording medium is attracted to the rotating body and turns, and an image is recorded on the other side of the recording medium when the recording medium is straightly conveyed by the straight transport unit.

In this manner, the recording apparatus suffices with one rotating body such as a drum that attracts and retains the recording medium and rotates, and straight transport unit such as transport belt. Thus, the space occupied by the transport unit can be reduced and the recording apparatus can be made compact in comparison to conventional technology where two rotating bodies are disposed.

Also, when an image is to be recorded only on one side of the recording medium, it suffices to stop the operation of the attraction separation unit and for the recording medium to be straightly conveyed by the straight transport unit without causing the recording medium to be attracted to the rotating body. Thus, the amount of transport time in the case of one-sided printing can be shortened and the printing speed can be raised in comparison to conventional technology where the recording medium is continually snaked.

Also, thick paper that is difficult to curve becomes conveyable by stopping the operation of the attraction separation unit and straightly conveying the recording medium with the straight transport unit without causing the recording medium to be attracted to the rotating body.

The recording apparatus may further include a recording head moving unit that moves the recording head between a first recording position that faces the first recording region and a second recording position that faces the second recording region.

In this recording apparatus, the recording head is moved between the first recording position and the second recording position by the recording head moving unit, and images are recorded on both sides of the recording medium.

The recording apparatus may further include a control unit which, in a job where double-sided printing has been designated, executes a front side printing process where the control unit activates the recording head moving unit to cause the recording head to move to the first recording position, activates the attraction separation unit to cause the recording medium conveyed by the straight transport unit to be attracted to and retained on the rotating body, activates the recording head to record an image on a front side of the recording medium attracted to and retained on the rotating body, and activates the attraction separation unit to separate the recording medium on which the image has been recorded from the rotating body, and a back side printing process where the control unit activates the recording head moving unit to cause the recording head to move to the second recording position, and activates the recording head to record an image on a back side of the recording medium conveyed by the straight transport unit.

In this recording apparatus, when double-sided printing has been designated, the control unit executes the front side printing process and the back side printing process and records images on both sides of the recording medium. In the front side printing process, the control unit activates the recording head moving unit to cause the recording head to move the first recording position. The control unit also activates the attraction separation unit to cause the recording medium conveyed by the straight transport unit to be attracted to and retained on the rotating body. Then, the control unit activates the recording head to record an image on the front side of the recording medium attracted to and retained on the rotating body and turning, and activates the attraction separation unit to separate the recording medium on which the image has been recorded from the rotating body.

In the back side printing process, the control unit activates the recording head moving unit to cause the recording head to move to the second recording position, and activates the recording head to record an image on the back side (the side opposite from the side on which an image is recorded in the front side printing process) of the recording medium conveyed by the straight transport unit. It will be noted that either the front side printing process or the back side printing process may be conducted first.

In the recording apparatus, in a job where face up or face down has been designated, the control unit may select one of the front side printing process and the back side printing process in accordance with the designation of face up or face down and record an image only on the front side or only on the back side of the recording medium.

In this recording apparatus, in a job where face up or face down has been designated (i.e., whether the image recording surface of the recording medium is to face up or face down when the recording medium is discharged), the control unit selects one of the front side printing process and the back side printing process in accordance with the designation of face up or face down and records an image only on the front side or only on the back side of the recording medium. Thus, the recording apparatus can be made compact and the cost can be reduced, because a dedicated transport path for inverting the recording medium on which an image is recorded and which is discharged becomes unnecessary. Also, the transport time of the recording medium after image recording can be shortened.

In the recording apparatus, in a job where thick paper has been designated as the recording medium, the control unit may record an image only on the back side of the recording medium.

In this recording apparatus, in a job where thick paper has been designated as the recording medium, the control unit records an image only on the back side of the recording medium. Namely, thick paper that is difficult to curve is straightly conveyed by the straight transport unit without being attracted to and retained on the rotating body. Thus, the rotation radius of the rotating body can be set without consideration of the curvature of thick paper, whereby the rotating body can be made compact and the recording apparatus can be made compact.

The recording apparatus may further include a behavior stabilizing unit that is disposed between the attraction separation unit and the second recording region and stabilize the behavior of the recording medium conveyed to the straight transport unit.

In this recording apparatus, behavior stabilizing unit such as a roll is disposed between the attraction separation unit and the second recording region, and the behavior stabilizing unit stabilize the behavior of the recording medium separated from the rotating body by the attraction separation unit and conveyed to the straight transport unit. Thus, the image quality of image recording conducted after the recording medium is separated from the rotating body can be stabilized.

The recording apparatus may further include a drying unit that is disposed at the transport-direction downstream side from the recording part of the recording head of the looped transport unit and dries the front side of the recording medium on which the image has been recorded.

In this recording apparatus, a drying unit is disposed at the transport-direction downstream side from the first recording region, and the drying unit dries the front side of the recording medium on which the image has been recorded. For this reason, the ink image is not disturbed even if the image recording surface of the recording medium sent to the straight transport unit from the looped transport unit contacts the straight transport unit such as transport belt.

In the recording apparatus, the recording head may be configured by a first recording head disposed facing the first recording region and a second recording head disposed facing the second recording region.

In this recording apparatus, the first recording head is disposed facing the first recording region, and the second recording head is disposed facing the second recording region. The first recording head forms an image on one side of the recording medium conveyed by the looped transport unit. The second recording head forms an image on the other side of the recording medium conveyed by the straight transport unit.

Because the present invention is configured as described above, a recording apparatus that records an image on both sides of a recording medium can be made compact, and the amount of transport time when recording an image on only one side can be shortened. The invention can also accommodate transport of thick paper and jobs where face up or face down has been designated, without increasing the size of the recording apparatus.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004- 227569 filed on Aug. 4, 2004 including specification, claims, drawings and abstract is incorporated herein by reference in its entirety.

What is claimed is:

1. A recording apparatus comprising a transport unit that conveys a recording medium and a recording head unit that records an image on the recording medium conveyed by the transport unit, wherein the transport unit comprises a straight transport unit that straightly conveys the recording medium, and a looped transport unit that branches and turns from the straight transport unit and returns the recording medium to the straight transport unit in a looped manner, a first recording region is disposed at the looped transport unit, and a second recording region is disposed at the straight transport unit, and the recording head unit comprises a recording head and a recording head moving unit that moves the recording head between a first recording position that faces the first recording region and a second recording position that faces the second recording region.

2. The recording apparatus of claim 1, wherein the looped transport unit is a rotating body that attracts and retains the recording medium and rotates, and the recording apparatus further comprises an attraction separation unit that causes the recording medium conveyed by the straight transport unit to be attracted to and retained on the rotating body, separates the recording medium attracted to and retained on the rotating body from the rotating body, and guides the recording medium to the straight transport unit.

3. The recording apparatus of claim 2, further comprising a behavior stabilizing unit that is disposed between the attraction separation unit and the second recording region and stabilizes the behavior of the recording medium conveyed to the straight transport unit.

4. The recording apparatus of claim 2, wherein the recording head unit comprises a first recording head that faces the first recording region and a second recording head that faces the second recording region.

5. The recording apparatus of claim 1, further comprising a control unit which, in a job where double-sided printing has been designated, executes a front side printing process where the control unit activates the recording head moving unit to move the recording head to the first recording position, activates the attraction separation unit to cause the recording medium conveyed by the straight transport unit to be attracted to and retained on the rotating body, activates the recording head to record an image on a front side of the recording medium attracted to and retained on the rotating body, and activates the attraction separation unit to separate the recording medium on which the image has been recorded from the rotating body, and a back side printing process where the control unit activates the recording head moving unit to move the recording head to the second recording position, and activates the recording head to record and image on a back side of the recording medium conveyed by the straight transport unit.

6. The recording apparatus of claim 5, wherein a job where face up or face down has been designated, the control unit selects on of the front side printing process and the back side printing process in accordance with the designation of face up or face down and records an image only on the front side or only on the back side of the recording medium.

7. The recording apparatus of claim 5, wherein in a job where thick paper has been designated as the recording medium, the control unit records an image only on the back side of the recording medium.

8. The recording apparatus of claim 1, further comprising a drying unit that is disposed at the transport-direction downstream side from the first recording region and dries the front side of the recording medium on which the image has been recorded.

9. The recording apparatus of claim 1, wherein the recording head unit comprises a first recording head that faces the first recording region and a second recording head that faces the second recording region.

* * * * *